United States Patent [19]

Sakurai et al.

[11] 4,216,908

[45] Aug. 12, 1980

[54] BURNER FOR LIQUID FUEL

[75] Inventors: Sumio Sakurai, Yokohama; Takashi Hirano, Tokyo, both of Japan

[73] Assignee: Nippon Sanso K. K., Minato, Japan

[21] Appl. No.: 919,287

[22] Filed: Jun. 26, 1978

[30] Foreign Application Priority Data

Jun. 30, 1977 [JP] Japan ..... 52-78225

[51] Int. Cl.[2] ..... B05B 15/00

[52] U.S. Cl. ..... 239/132.3; 239/406

[58] Field of Search ..... 239/400–404, 239/406, 132.3

[56] References Cited

U.S. PATENT DOCUMENTS

| | | | |
|---|---|---|---|
| 1,451,063 | 4/1923 | Anthony | 239/406 |
| 1,536,046 | 5/1925 | Anthony | 239/406 |
| 2,373,595 | 4/1945 | Peeps | 239/406 X |
| 2,682,302 | 6/1954 | Cote | 239/406 |
| 2,920,001 | 1/1960 | Smith | 239/132.3 X |
| 2,941,587 | 6/1960 | Hagy | 239/132.3 |

*Primary Examiner*—Richard A. Schacher

*Attorney, Agent, or Firm*—Kane, Dalsimer, Kane, Sullivan and Kurucz

[57] ABSTRACT

A burner for liquid fuel of a type to burn a mixture of liquid fuel and auxiliary combustion gas individually fed into a combustion chamber, which comprises a liquid fuel supply conduit within said burner, said conduit having a truncated conical tip with a spraying nozzle on the trapezoidal plane, an assembly for forming auxiliary combustion gas supplying passages disposed around said conduit and a combustion chamber formed by a jacket and said assembly for burning mixture of fuel and gas individually supplied therein, particularly said gas passing through branched paths and branched parts of auxiliary combustion gas is belched near the liquid fuel spraying nozzle.

14 Claims, 10 Drawing Figures

BURNER FOR LIQUID FUEL

BACKGROUND OF THE INVENTION

The present invention relates to a burner for burning liquid fuel of a type to burn a mixture of liquid fuel and auxiliary combustion gas which are individually fed into a combustion chamber to be burned therewithin, and in particular, relates to a burner in which atomization of liquid fuel is accelerated to effect further more perfect combustion thereof as well as prevention for deposition of unburnt substance or carbon on and near a liquid fuel spraying nozzle in the course of burning within the combustion chamber.

A conventional burner for burning liquid fuel of this type mentioned above is generally constructed in such a manner that said burner is provided at the front end portion thereof with a combustion chamber encompassed by a water-cooled or air-cooling jacket, and liquid fuel is adapted to be belched out of said combustion chamber at the portion nearly the centre thereof while auxiliary combustion gas is belched out of the portion near said jacket on the outer periphery of said combustion chamber, said belched-out liquid fuel is adapted to be mixed with said auxiliary combustion gas at the portion adjacent to the inner peripheral wall of said combustion chamber to be burned. Such a mechanism of the conventional burner suffers from various drawbacks and inconveniences. For instance, since spouting nozzles of both liquid fuel and auxiliary combustion gas are disposed separately far from one another to cause imperfect mixture of them, one part of liquid fuel converted into a form of atomized fine grains are not burned and come into contact with the inner peripheral wall of said combustion chamber to cause mutual recombination into coarse particles or conversion into dewdrops which are deposited on the inner peripheral wall in a form of unburnt substance. Further, since atomization of belched liquid fuel is imperfect, said imperfectly atomized liquid fuel is not thoroughly mixed with said auxiliary combustion gas such as, for instance, air, oxygen or the like, to be splashed out of flames. This results in imperfect combustion which is accompanied with growth of soot. Still further, shortage in the amount of auxiliary combustion gas supplied near the spraying nozzle for liquid fuel brings about deposition of carbon on and around said spraying nozzle which blocks up said nozzle.

SUMMARY OF THE INVENTION

The present invention is adapted to provide a burner for liquid fuel which eliminates drawbacks of conventional burners and is also capable of accelerating atomization of liquid fuel for spraying as well as effecting perfectibility of mixing said liquid fuel with said auxiliary combustion gas by flowing a parts of auxiliary combustion gas, such as air, oxygen or oxygen rich air near the liquid fuel spraying nozzle, then accompanying none of carbon to be deposited in the course of burning.

The present invention will now be described in detail referring to the drawings by way of example in a form of embodiments of the invention.

BRIEF DESCRIPTION OF THE DRAWINGS

FIG. 3 to FIG. 8 show respectively embodiments of constituent elements for forming an auxiliary combustion gas supplying passage, in which FIG. 3 is a semi-sectional side elevation of one embodiment;

FIG. 4 is a sectional view taken along lines A–A′ of FIG. 3;

FIG. 5 is a semi-sectional side elevation of the other embodiment;

FIG. 6 is an elevational view of the embodiment shown in FIG. 5;

FIG. 7 is a semi-sectional side view of another embodiment;

FIG. 8 is an elevational view of said another embodiment shown in FIG. 7;

DESCRIPTION OF THE PREFERRED EMBODIMENTS

Figure 1:
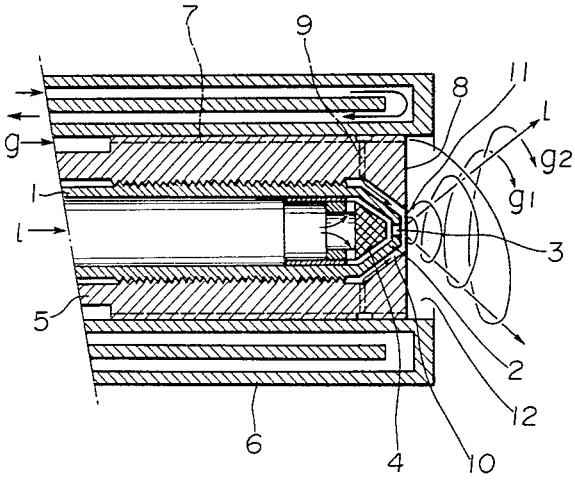
FIG. 1 is a side cross-sectional view of a burner according to the present invention showing the tip portion thereof.
Figure 2:
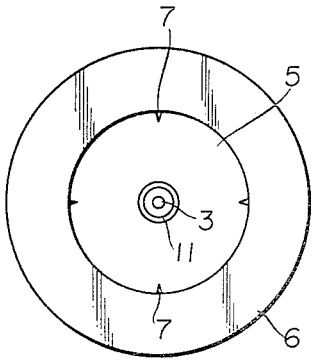
FIG. 2 is an elevational view of the above burner.

In FIGS. 1 and 2, a liquid fuel supply conduit 1 is provided in the centre of a burner, the tip of said conduit 1 is formed in a truncated conical tip portion 2 of a liquid fuel supply conduit having a trapezoidal conical shape and a liquid fuel spraying nozzle 3 is formed in the centre on the tip plane of the truncated conical shape. A swirler 4 for whirling liquid fuel is accommodated within the inner part of the truncated conical tip portion 2 of the liquid fuel supply conduit. The liquid fuel is whirled by the swirler 4 and sprayed in a whirl to form a conical shape having a predetermined angle to be atomized. Said swirler 4 is normally provided with striations, and with the aid of said striations, said liquid fuel fed into the conduit from the portion designated by the symbol 1 located on the left side of said conduit shown in FIG. 1 is whirled. The circling direction of said liquid fuel may, in some cases, be the same as that of auxiliary combustion gas which will be described hereinafter, while in other cases may be inverse to the circling direction of said auxiliary combustion gas. The circling direction whether it be same or inverse to that of auxiliary combustion gas is, however, determined to an appropriate direction due to kinds and other factors of said liquid fuel.

Figure 4:
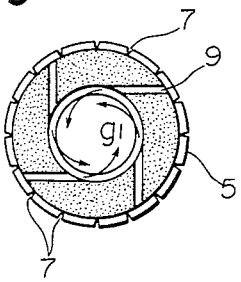
Figure 3:
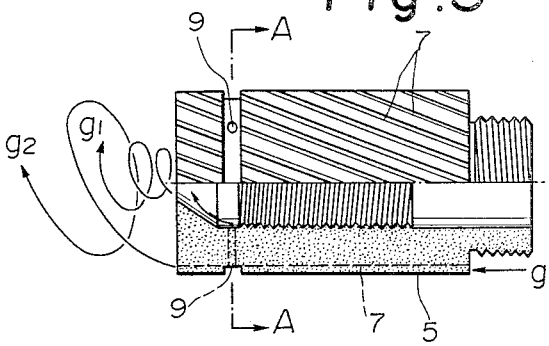

The liquid fuel supply conduit 1 is provided on the outer periphery thereof with an assembly 5 for forming auxiliary combustion gas supplying passages, and a plurality of spiral striations are formed on the portion which is in contact with a water-cooled jacket 6 disposed on the outside along the outer periphery of said supplying passages forming assembly 5. Said spiral striations are adapted to form supply passages 7 for auxiliary combustion gas such as air, oxygen or the like, and said supplying passages are terminated to be opened in a combustion chamber 12 encompassed by both the front end surface 8 of said assembly 5 and the water-cooled or an air cooling jacket 6. Said auxiliary combustion gas supplying passages 7 branch off inside of said front end surface 8 for forming auxiliary combustion gas supplying passages as shown in FIG. 3 to form a plurality of flowing paths 9 which are arranged to be perpendicular to the axis of said assembly 5 and in the direction of the tangential line with respect to said liquid fuel supply conduit 1 as shown in FIG. 4. Said branched-off flowing paths 9 for supplying auxiliary combustion gas are opened in a clearance formed between said truncated conical tip portion 2 of the liquid fuel supply conduit 1 and the assembly 5 for forming auxiliary combustion gas supplying passages, that is, in a flow path 10 having an annular truncated conical shape for supplying auxiliary combustion gas. Accordingly, auxiliary combustion gas fed from a portion designated by the symbol g located on the left side of said conduit 1 as shown in FIG. 1 is advanced to said branched-off flow paths 9 for supplying auxiliary combustion gas and swirled around siad truncated conical tip portion 2 of the liquid fuel supply conduit 1, then passes through said flow path 10 having an annular truncated conical shape for supplying auxiliary combustion gas, and is sprayed in a form of converging jet toward the central axis from an aperture 11 of an annular truncated conical flow path opened at the front end surface 8 of said assembly 5. Said auxiliary combustion gas thus ejected is mixed with liquid fuel belched through the spraying nozzle 3 for liquid fuel to be burnt within the combustion chamber 12 formed between the front end surface 8 of said assembly 5 and the front end portion of the water-cooled or an air cooling jacket 6 extending beyond the end surface of the assembly. In this instance, since said auxiliary combustion gas thus belched is sprayed to be convergent about the central axis of the conduit 1 as elucidated hereinbefore, said auxiliary combustion gas is sufficiently admixed with the sprayed liquid fuel to the utmost, thus resulted in said liquid fuel converted into the state of still more complete atomization. Moreover, as said auxiliary combustion gas is fully supplied to be mixed with said liquid fuel at the portion near said spraying nozzle 3, such troubles as imperfect combustion or carbonization of liquid fuel will never occur, thereby accompanies no drawbacks, for instance, blocking up the spraying nozzle 3 and the like. On the other hand, auxiliary combustion gas advanced to no ramification through the supplying passages 7 for flowing auxiliary combustion gas is belched to envelop burning flames therewithin so as to feed oxygen abundantly around said flames which are burning the atomized liquid fuel having been admixed with auxiliary combustion gas to achieve perfect combustion. According to the present inventive burner, auxiliary combustion gas is adapted to be ramified into two directions as described above so as to be admixed with liquid fuel to cause reaction between them in such a manner that one part designated by the symbol g1 of said auxiliary combustion gas is belched in one direction to be convergent about the central axis of the conduit 1 while the other part designated by the symbol g2 of said auxiliary combustion gas is belched in the other direction to envelop said burning flames. Perfect combustion can accordingly be effected.

Figure 6:
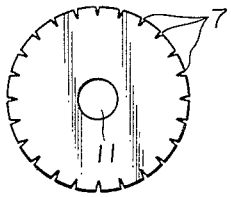
Figure 5:
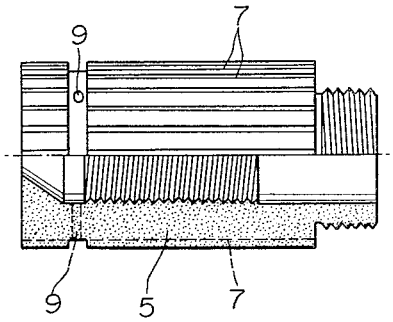
Figure 8:
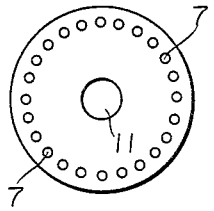
Figure 7:
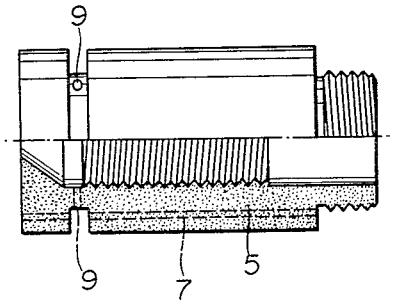

The supply passages 7 can be provided on said assembly 5 for forming auxiliary combustion gas supplying passages according to one embodiment in which spiral striations are engraved on said assembly 5 at the outer peripheral surface thereof as set forth hereinbefore, and according to another embodiment mentioned below for providing different types of striations. For instance, according to the other embodiment, a plurality of linear striations are engraved on said assembly 5 on the outer peripheral surface thereof as shown in FIG. 5 and FIG. 6 respectively. Further in another embodiment, a plurality of linear throughholes are provided circularly around the central axis of said assembly 5 as shown in FIG. 7 and FIG. 8 respectively. Moreover, according to a still further embodiment, a plurality of spiral throughholes are provided circularly around the central axis of said assembly 5 just the same way as explained in the preceding embodiment.

The above-mentioned embodiments which provide throughholes or striations should be optimally selected in consideration of the combination of the following mentioned factors that the formation of flames becomes different in the shape thereof depending upon the kinds of liquid fuel and the kinds of auxiliary combustion gas.

Figure 10:
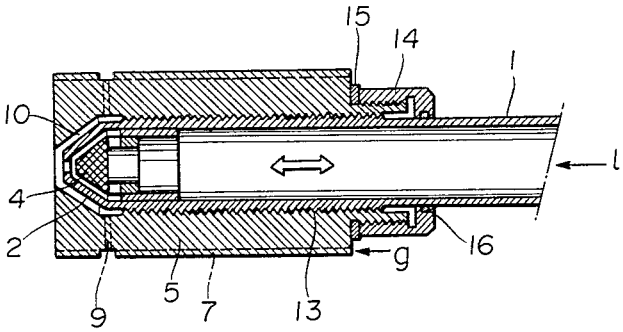
FIG. 10 is a sectional side elevation of a burner with reference to the embodiment according to the present invention in claim 5 showing the tip portion of the burner.

Furthermore, the supplying amount and the jet velocity of auxiliary combustion gas belched out of the spouting aperture 11 of annular truncated conical flow paths through the branched-off flowing paths 9 for supplying auxiliary combustion gas should sometimes be adjusted corresponding to the properties of flames such as, acidic flame, neutral flame or reducing flame, and the amount of carbon deposited near the liquid fuel spraying nozzle 3 depending upon the kinds of fuel and the like. In such cases as set forth above, the burner according to the present invention can be constructed to such a structure as being capable of adjusting the dimension (the space of clearance) of the annular truncated conical flow path 10 for supplying auxiliary combustion gas. FIG. 10 is a detailed view of the burner according to the present invention showing the structure thereof. In other words, the liquid fuel supply conduit 1 and the assembly 5 for forming auxiliary combustion gas supplying passages are adjusted by a screw 13 and are securely fixed at their relative locations by a cap nut 14. In this instance, auxiliary combustion gas intended to be counterflowing from said annular truncated conical flow path 10 for supplying auxiliary combustion gas is sealed with packing 15 and an O-ring 16.

Figure 9:
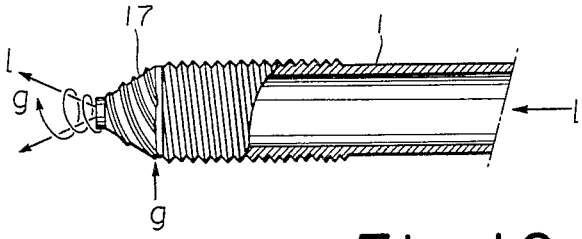
FIG. 9 is a fragmentary sectional side elevation of a liquid fuel supply conduit showing the same in a form of the other embodiment.

On the other hand, it may happen that the supplying amount and the jet velocity of auxiliary combustion gas belched out of the spouting aperture 11 of the annular truncated conical flowing paths have been reached predetermined values respectively and do not need to be adjusted. In such a case, since the mutual relation of positions between the liquid fuel supply conduit 1 and the assembly 5 for forming auxiliary combustion gas supplying passages is left to be stationary as they are located, spiral striations 17 are provided on the front end portion of the liquid fuel supply conduit 1, that is, on the outer peripheral surface of the truncated conical end portion 2 of said liquid fuel supply conduit shown in FIG. 9 so as to subject said spiral striation to be as the passage of auxiliary combustion gas.

Accordingly, the annular truncated conical path 10 for flowing auxiliary combustion gas is turned out to be the stationary spiral striation flow passage.

The structure of the burner according to the present invention may clearly be understood from the aforementioned description. The burner will further be explained concerning its characteristics as well as its effects.

The supplying passages 7 for flowing auxiliary combustion gas branch 9 so as to subject said auxiliary combustion gas to be whirled and belched in a convergent shape toward the central axis of the conduit 1. Mixing of said auxiliary combustion gas with liquid fuel is enhanced and atomization of liquid fuel is accelerated, providing still more perfect combustion. Further, as a result of effecting perfect combustion set forth above, growth of unburnt substances and carbon near the spraying nozzle is prevented as well as the blocking up up said spraying nozzle.

The other part of ramified auxiliary combustion gas is adapted to be belched out of the passage 7 provided at positions somewhat far from the liquid fuel spraying nozzle to envelop flames, so that oxygen is fed to flames from outside formed by buring the mixture of said liquid fuel and auxiliary combustion gas which have previously been mixed with each other. This results in still more perfect combustion. Due to the foregoing mechanism of the burner according to the present invention, liquid fuel can be kept stably in perfect combustion for a long period of time without increasing the supply of auxiliary combustion gas as well as accompanying no growth of unburnt substance or carbon.

Furthermore, an adjustment mechanism can be selected in accordance with the flow rate as well as the velocity of flow of auxiliary combustion gas. When adjusting the flow rate and the velocity of flow of auxiliary combustion gas is unnecessary, the mechanism in which the flowing passages of auxiliary combustion gas are fixed can be selected in accordance with the object mentioned above.

What is claimed is:

1. A burner for liquid fuel comprising a liquid fuel supply conduit having a tip portion provided with a fuel spraying nozzle at the front end portion thereof, an assembly for forming auxiliary combustion gas supplying passages, said assembly being disposed on the outer periphery of said liquid fuel supply conduit, a cooling jacket provided on the outer periphery of said assembly, and a combustion chamber formed by the inner peripheral surface at the front end portion of said jacket and the end surface of said assembly, said burner characterized in that one part of said auxiliary combustion gas passing through the auxiliary combustion gas flowing passage is ramified, and this branched-off flow of the auxiliary combustion gas is adapted to run along the outer periphery of the tip portion of the liquid fuel supply conduit to be belched out into the combustion chamber from parts which are formed on the end surface of said assembly and also on the outer periphery of the fuel spraying nozzle of the liquid fuel supply conduit.

2. A burner according to claim 1 which is characterized by such a structure that the belching ports of branched-off flowing paths for said auxiliary combustion gas are opened in the direction of the tangential line with respect to said liquid fuel supply conduit to belch out the auxiliary combustion gas passed through said flowing paths in a whirl.

3. A burner according to claim 1 or claim 2 which is further characterized by that the front end portion of said liquid fuel supply conduit is formed in a truncated conical shape and is provided at the centre part thereof with the spraying nozzle, moreover, a clearance formed between said truncated conical part and the assembly for forming auxiliary combustion gas supplying passages is rendered to serve as a belching portion of branched-off flow paths for said auxiliary combustion gas.

4. A burner according to claim 3 which is further characterized by that said truncated conical portion is provided with spiral striations which are rendered to serve as a belching portion of said branched-off flowing paths for auxiliary combustion gas.

5. A burner for liquid fuel comprising a liquid fuel supply conduit having a tip portion provided with a fuel spraying nozzle at the front end portion thereof, and assembly for forming auxiliary combustion gas supplying passages which have auxiliary gas flowing paths, said assembly disposed on the outer periphery of said liquid fuel supply conduit, a cooling jacket provided on the outer periphery of said assembly, a combustion chamber formed by an inner peripheral surface at the front end portion of said jacket and the end surface of said assembly, whereby liquid fuel is belched out of said spraying nozzle while auxiliary combustion gas is sprayed through said auxiliary combustion gas flowing paths individually to each other into the combustion chamber respectively so as to stream one part of said auxiliary combustion gas along the outer periphery of the tip portion of said liquid fuel supply conduit and to belch said gas into said combustion chamber from the outer periphery of said spraying nozzle, thereby said one part of auxiliary combustion gas is mixed with both the other part of said auxiliary combustion gas and said liquid fuel which have individually been belched into said combustion chamber, this effecting combustion of liquid fuel, said burner characterized in that said liquid fuel supply conduit is constructed to be movable with respect to said assembly, and the flowing path is made to have an adjustable width at the belching portion of said auxiliary flowing paths which are formed by said assembly and the outer peripheral portion of said liquid fuel supply conduit.

6. A burner according to claim 5 wherein said liquid fuel supply conduit is constructed to be slidable with respect to said assembly.

7. A burner according to claim 5 wherein said liquid fuel supply conduit is constructed to be helically rotatable with respect to said assembly.

8. A burner for fluid fuel, comprising:

a liquid fuel supply having a tip portion formed at its front end;

a fuel spraying nozzle formed in the tip portion of said conduit;

an assembly disposed on the outer periphery of said liquid fuel supply conduit, there being a clearance formed between the tip portion of the conduit and said assembly;

a cooling jacket provided on the outer periphery of said assembly, said cooling jacket having a front end portion extending beyond the front end of said assembly;

a combustion chamber defined by the inner peripheral surface of the portion of said jacket extending beyond the assembly and the front end surface of said assembly;

a plurality of auxiliary combustion gas supplying passages within said assembly, said passages having terminal openings allowing the passage of gas into said combustion chamber;

a plurality of flow paths branching off from said passages inside the front end surface of said assembly, said flow paths opening into said clearance between said tip portion of said conduit and said assembly, gas being able to flow from said clearance and mix with liquid fuel from said nozzle, the openings of the auxiliary gas supplying passages being positioned such that gas belched therefrom envelopes flames formed within said combustion chamber.

9. A burner as described in claim 8 wherein said conduit has a truncated conical tip portion, the clearance between said assembly and said tip portion having a truncated conical shape such that gas from said flow paths is sprayed in the form of a converging jet from said clearance into said combustion chamber, thereby enhancing atomization of liquid fuel from said nozzle.

10. A burner as described in claim 8 or claim 9 wherein said auxiliary combustion gas supplying passages are formed by striations in said assembly where it adjoins said cooling jacket.

11. A burner as described in claim 8 or claim 9 wherein said flow paths are arranged in the direction of the tangential line with respect to said conduit such that combustion gas is swirled around said tip portion.

12. A burner as described in claim 9 wherein said truncated conical tip portion is provided with spiral striations.

13. A burner as described in claim 8 or claim 9 further including means for adjusting the clearance between said tip portion and said assembly.

14. A burner as described in claim 8 wherein said jacket is a water cooling jacket.

* * * * *

UNITED STATES PATENT AND TRADEMARK OFFICE

CERTIFICATE OF CORRECTION

PATENT NO. : 4,216,908

DATED : August 12, 1980

INVENTOR(S) : Sumio Sakurai and Takashi Hirano

It is certified that error appears in the above—identified patent and that said Letters Patent is hereby corrected as shown below:

Claim 5, column 6, line 1, "and" should be --an--;

Claim 8, column 6, line 36, after "supply", insert --conduit--。

Signed and Sealed this

*Third* Day of *March 1981*

[SEAL]

*Attest:*

RENE D. TEGTMEYER

*Attesting Officer*

*Acting Commissioner of Patents and Trademarks*